US006098794A

United States Patent [19]

Lin

[11] Patent Number: 6,098,794

[45] Date of Patent: Aug. 8, 2000

[54] CONTAINER HAVING ORNAMENT

[76] Inventor: Jenn-Shiun Lin, 6th Fl. 538, Sec. 5, Chung Shiaw E. Rd., Taipei, Taiwan

[21] Appl. No.: 09/320,742

[22] Filed: May 27, 1999

[30] Foreign Application Priority Data

Mar. 26, 1999 [TW] Taiwan ..... 88204752

[51] Int. Cl.[7] ..... B65D 85/72

[52] U.S. Cl. ..... 206/217; 206/457; 206/818; 215/6; 446/74; 446/75

[58] Field of Search ..... 206/217, 457, 206/818; 215/6, 10, 386; 446/73, 74, 75; 224/158–160

[56] References Cited

U.S. PATENT DOCUMENTS

| | | | |
|---|---|---|---|
| 4,098,397 | 7/1978 | Mann, Jr. et al. | 206/217 |
| 5,029,700 | 7/1991 | Chen | 206/217 |
| 5,419,436 | 5/1995 | Powell | 206/217 |
| 5,769,680 | 6/1998 | Hoffman | 446/75 |
| 5,881,868 | 3/1999 | Soyak et al. | 206/217 |

*Primary Examiner*—Bryon P. Gehman
*Assistant Examiner*—Luan K. Bui
*Attorney, Agent, or Firm*—Raymond Y. Chan; David and Raymond

[57] ABSTRACT

A container is provided therein with a hollow tubular body which is provided at the bottom end thereof with an end piece having a first magnet. An ornament is movably disposed in the hollow tubular body and is provided in the underside of the bottom thereof with a second magnet for bringing about a repulsion effect in conjunction with the first magnet. The ornament is caused by the repulsion effect to trip up and down in a reciprocating manner in the hollow tubular body at such time when the container is moved up and down. The ornament is also caused by the repulsion effect and the inertia effect of the ornament to suspend in the hollow tubular body.

6 Claims, 8 Drawing Sheets

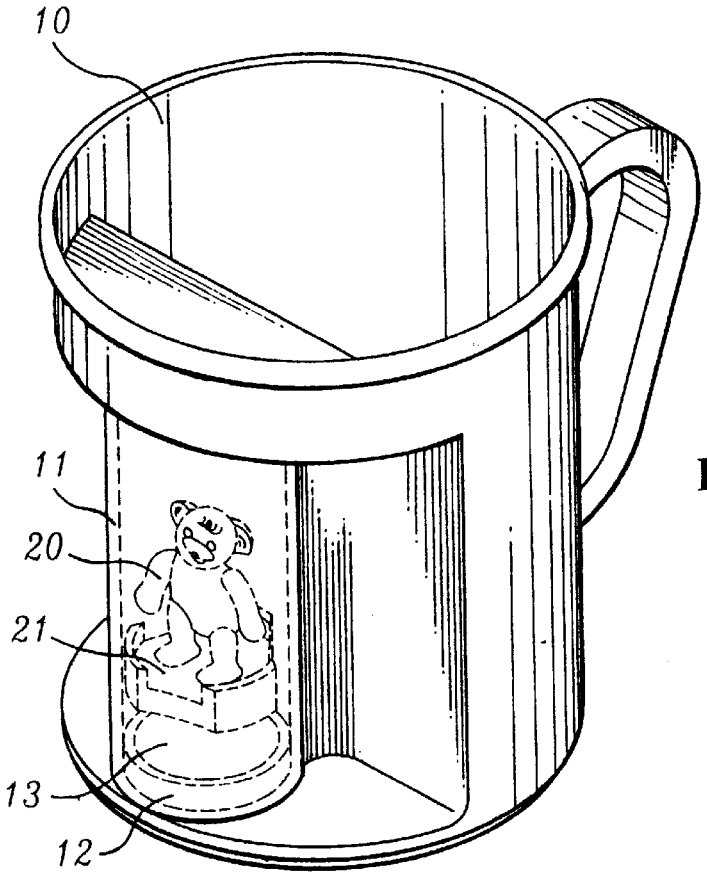
FIG. 1
FIG. 2
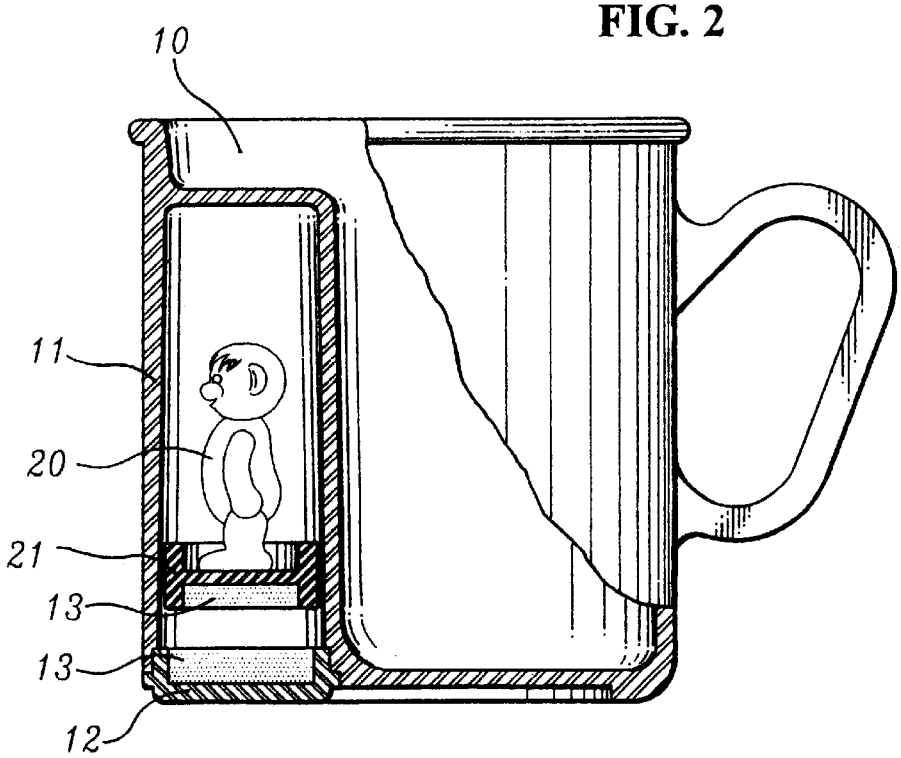

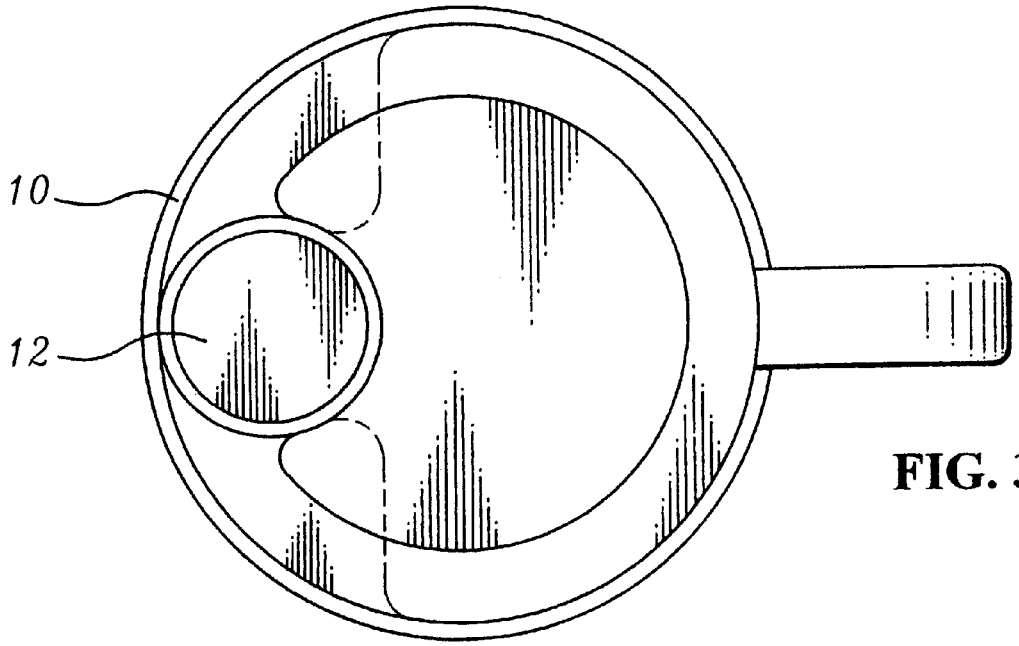
FIG. 3
FIG. 4
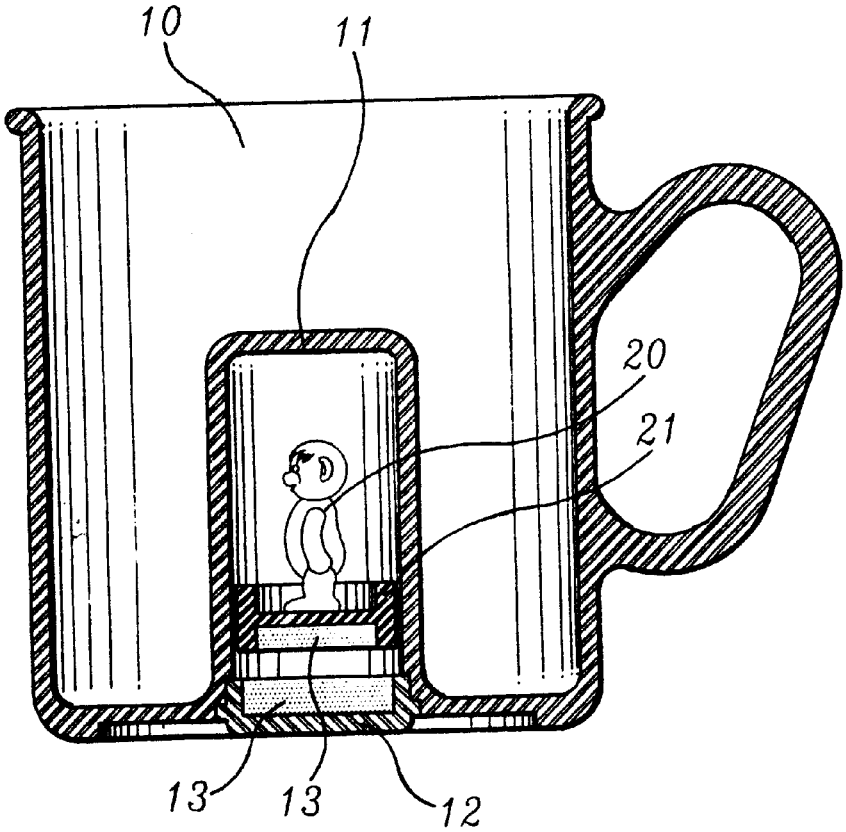

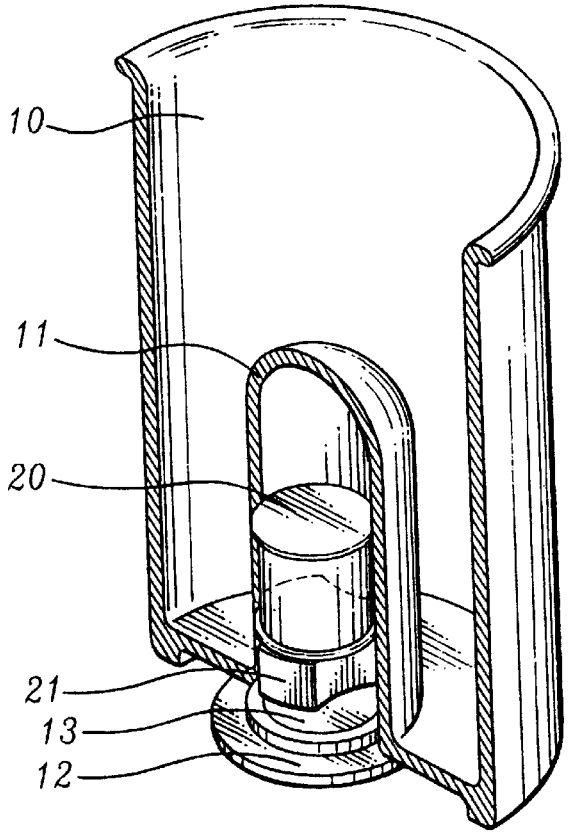
FIG. 5
FIG. 6
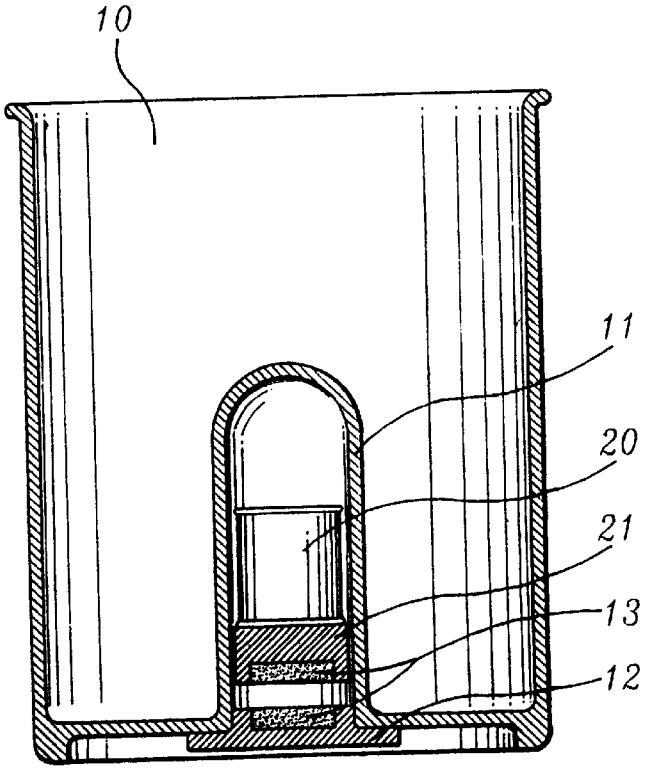

CONTAINER HAVING ORNAMENT

FIELD OF THE INVENTION

The present invention relates generally to a container, and more particularly to a container which is provided therein with a hollow tubular body for containing an ornament serving as a desirable adjunct to the container. The hollow tubular body is provided in the bottom end thereof with an end piece having a magnet. The ornament is movably disposed in the hollow tubular body and is provided at the bottom thereof with a magnet capable of repelling the magnet of the end piece of the hollow tubular body, thereby resulting in a reciprocating motion or a suspension of the ornament in the hollow tubular body at such time when the container is moved up and down.

BACKGROUND OF THE INVENTION

The conventional container, such as a water glass, waterpot, bottle, can, toothpick can, etc., is intended for a specific use and is not provided with anything serving to adorn the container. At best, the conventional container is made of a specific material to give it an added decorative effect. Certain conventional containers have various forms, colors, or grains serving to adorn the containers. Some conventional containers are coated on the outer surface thereof with various patterns or words serving to enhance the decorative effect of the containers.

Such conventional ways of decorating the containers as described above are monotonous and static at best, without providing the containers with a dynamic and lively means for enhancing the decorative effect of the containers.

SUMMARY OF THE INVENTION

The primary objective of the present invention is therefore to provide a variety of containers, such as water glass, waterpot, bottle, can, toothpick can and the like, with a hollow tubular body which is located inside the containers and is provided at the bottom end thereof with an end piece having a magnet. An ornament is movably disposed in the hollow tubular body and is provided at the bottom thereof with a magnet capable of repelling the magnet of the end piece of the hollow tubular body, thereby resulting in a reciprocating motion or a suspension of the ornament in the hollow tubular body at such time when the containers are moved up and down. As a result, the containers may be used to not only hold something but also to adorn a desk, room, bed headboard, etc.

The foregoing objective, features, functions, and advantages of the present invention will be more readily understood upon a thoughtful deliberation of the following detailed description of the embodiments of the present invention with reference to the accompanying drawings.

BRIEF DESCRIPTION OF THE DRAWINGS

FIG. 1 shows a perspective view of a first preferred embodiment of the present invention.

FIG. 2 shows a side partial sectional view of the present invention as shown in FIG. 1.

FIG. 3 shows a bottom view of the present invention as shown in FIG. 2.

FIG. 4 shows a sectional view of a second preferred embodiment of the present invention.

FIG. 5 shows a longitudinal sectional view of a third preferred embodiment of the present invention.

FIG. 6 shows a side sectional view of the third preferred embodiment of the present invention as shows in FIG. 5.

DETAILED DESCRIPTION OF THE PREFERRED EMBODIMENTS

Figure 7:
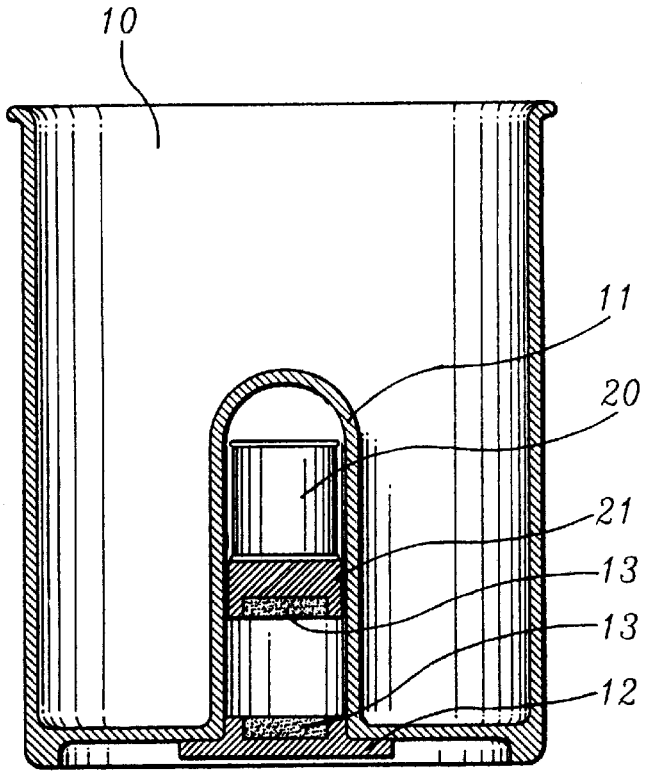
FIG. 7 shows a schematic view of the third preferred embodiment of the present invention at work.

As shown in FIGS. 1–3, the present invention comprises the component parts which are described hereinafter.

A main body 10 is of a cylindrical construction and is provided at an upper end thereof with an opening. The main body 10 is further provided in the outer side wall thereof with a handle attached thereto. The main body 10 has a hollow interior for holding a thing which may be either solid or liquid. The main body 10 is further provided in one side of the hollow interior thereof with a hollow tubular body 11, which is provided at the bottom end thereof with an end piece 12 fastened therewith. The end piece 12 is provided in the upper side thereof with a first magnet 13.

An ornament 20 is movably disposed in the hollow tubular body 11 located in the hollow interior of the main body 10. The underside of the bottom of the ornament 20 is provided with a second magnet 13, which is opposite in location to the first magnet 13 of the end piece 12 of the main body 10. In light of a repulsive effect brought about by the first magnet 13 and the second magnet 13, the ornament 20 moves up and down in a reciprocating manner in the hollow tubular body 11. In addition, the ornament 20 may be even suspended in the hollow tubular body 11.

As shown in FIG. 4, the tubular body 11, the ornament 20 and the magnets 13 may be located at the center of the hollow interior of the main body 10. In other words, the location of the present invention is not confined to the side wall of the hollow interior of the main body 10.

As shown in FIGS. 5–7, the present invention comprises a main body 10 devoid of a handle, and an ornament 20 different in form from the ornament described above with reference to FIGS. 1–3. FIG. 6 shows the main body 10 in the stationary state. In FIG. 7, the main body 10 is first moved up and down in a reciprocating manner and is then kept stationary, thereby resulting in the ornament 20 being suspended aimlessly in the hollow tubular body 11 due to the inertia effect of the ornament 20 and the repulsion effect of the first magnet 13 of the end piece 12 of the tubular body 11 and the second magnet 13 of the ornament 20.

Figure 8:
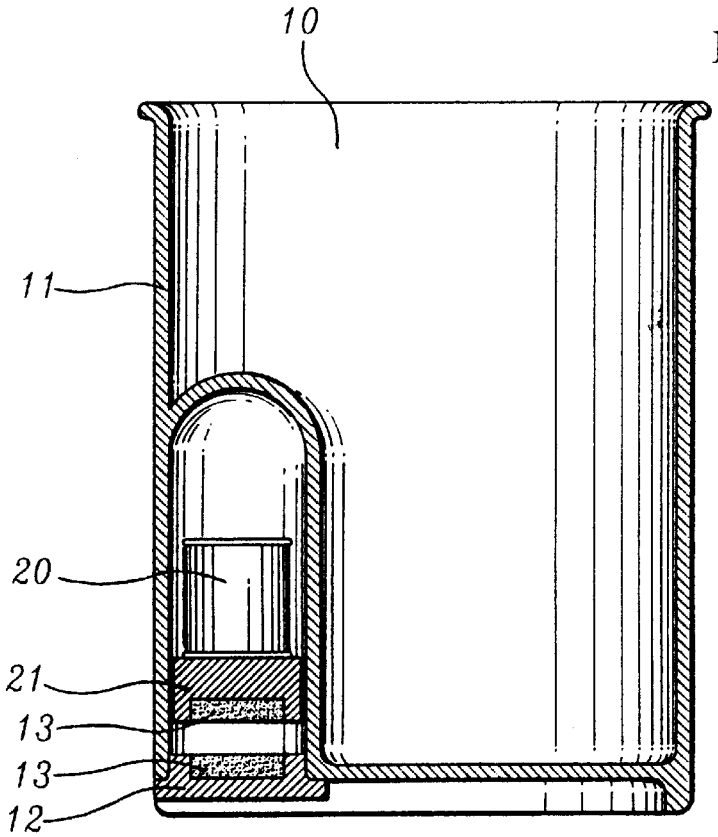
FIG. 8 shows a schematic view of another embodiment of the present invention as shown in FIG. 2.

The component parts of the embodiments described above with reference to FIGS. 5–7 are adapted to a main body 10 devoid of a handle, as shown in FIG. 8.

Figure 9:
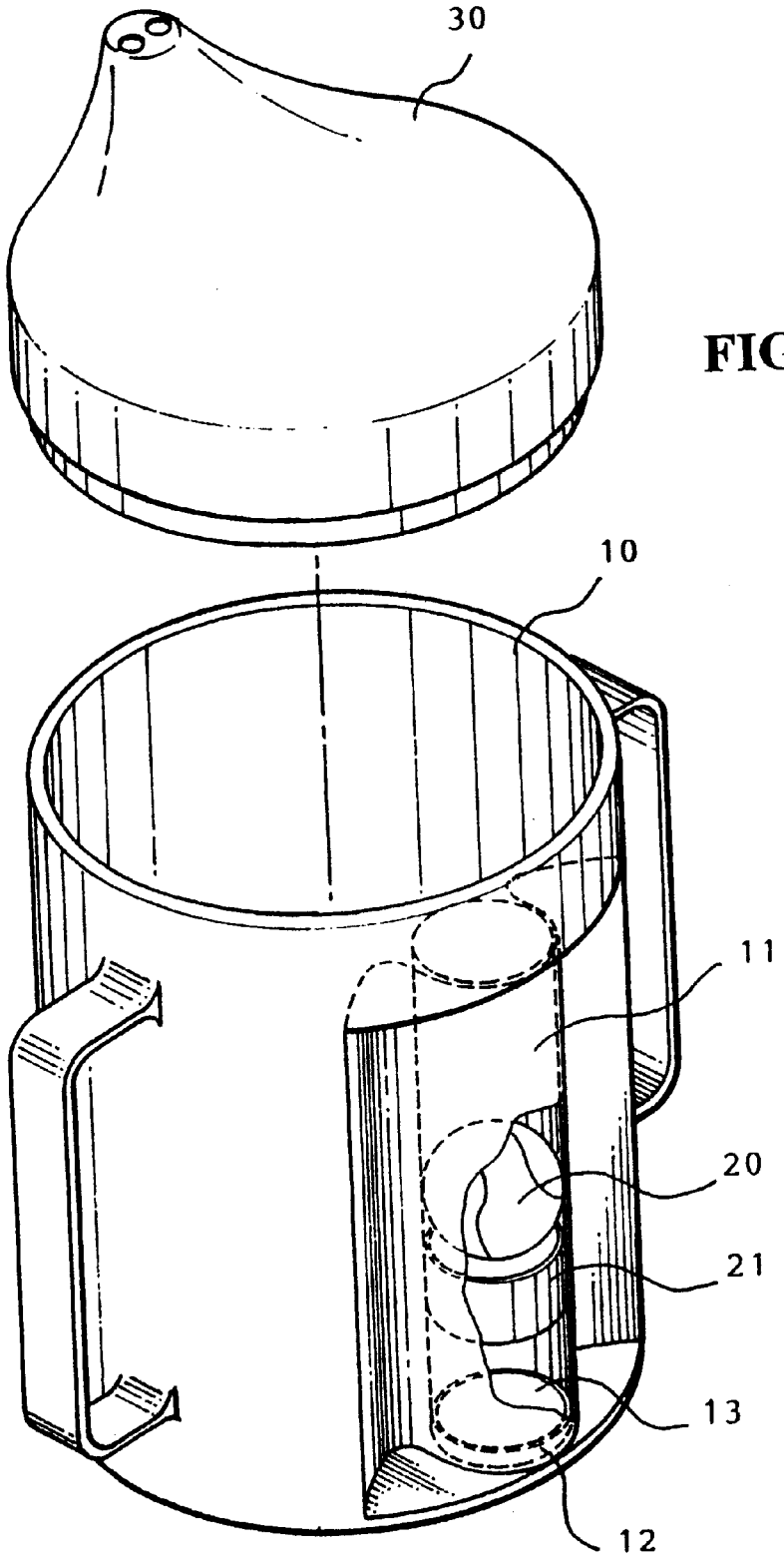
FIG. 9 shows a schematic view of the present invention which is embodied in a drinking water container for infant.

As shown in FIG. 9, the main body 10 of the container has two handles and is provided with a lid 30 which is intended for use by an infant to drink water contained in the main body 10.

Figure 10:
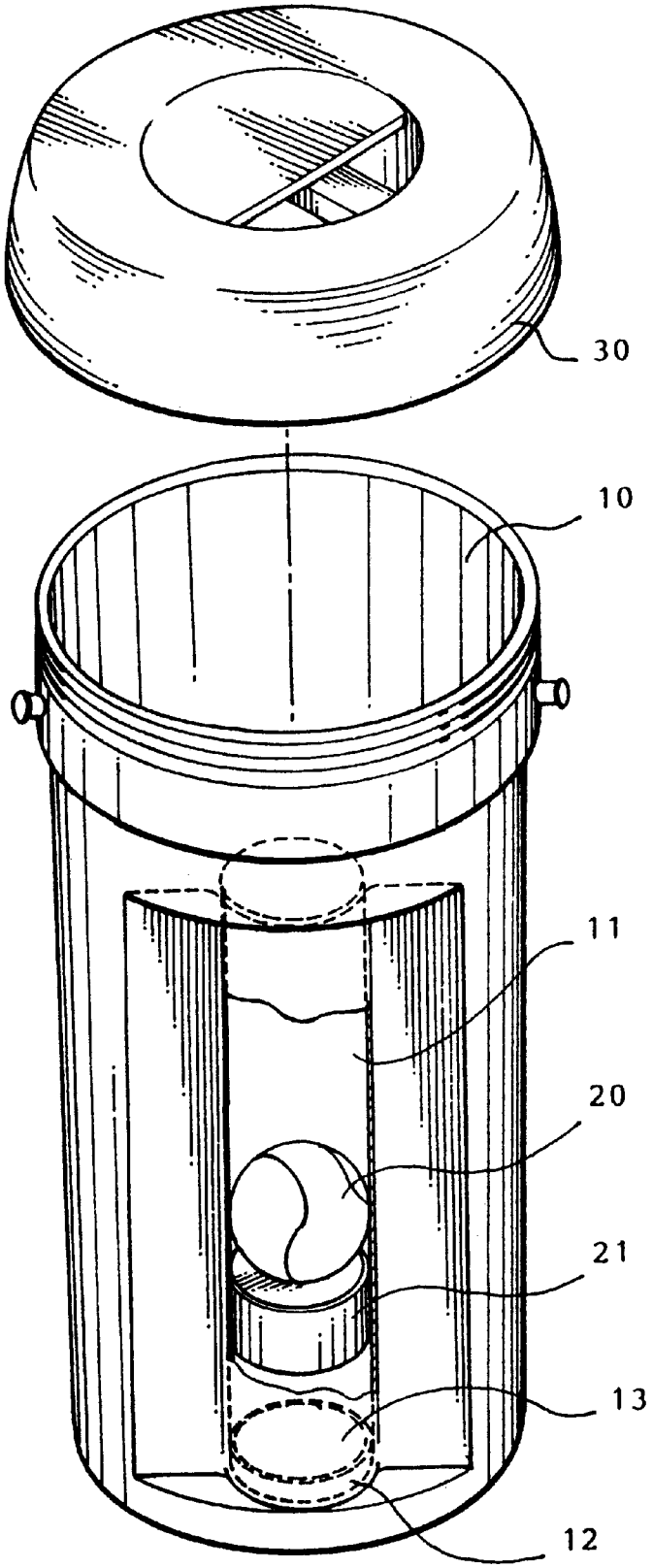
FIG. 10 shows a schematic view of the present invention which is embodied in a drinking water container having a shoulder strap.
Figure 11:
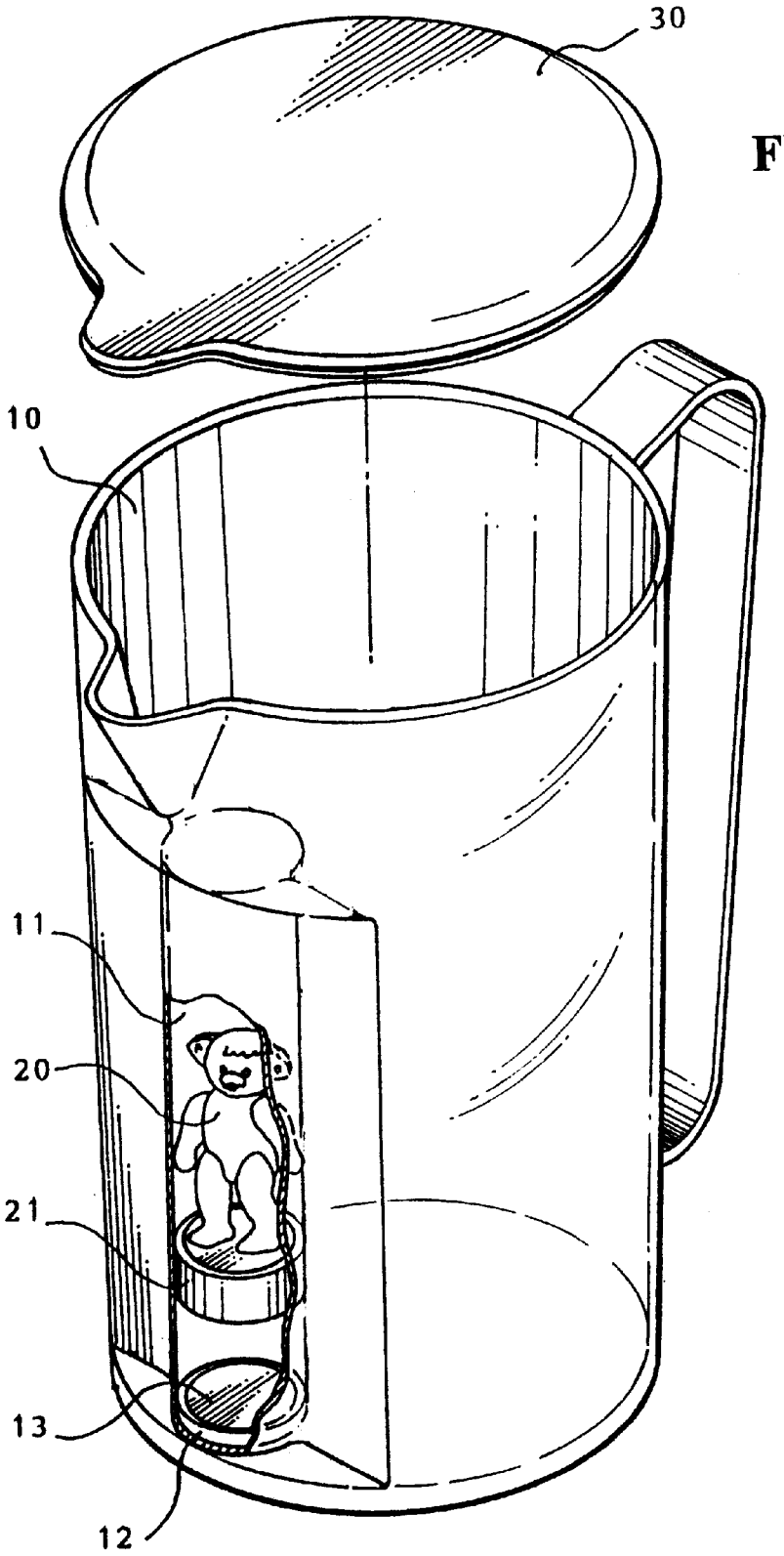
FIG. 11 shows a schematic view of the present invention which is embodied in a cup having a lid.
Figure 12:
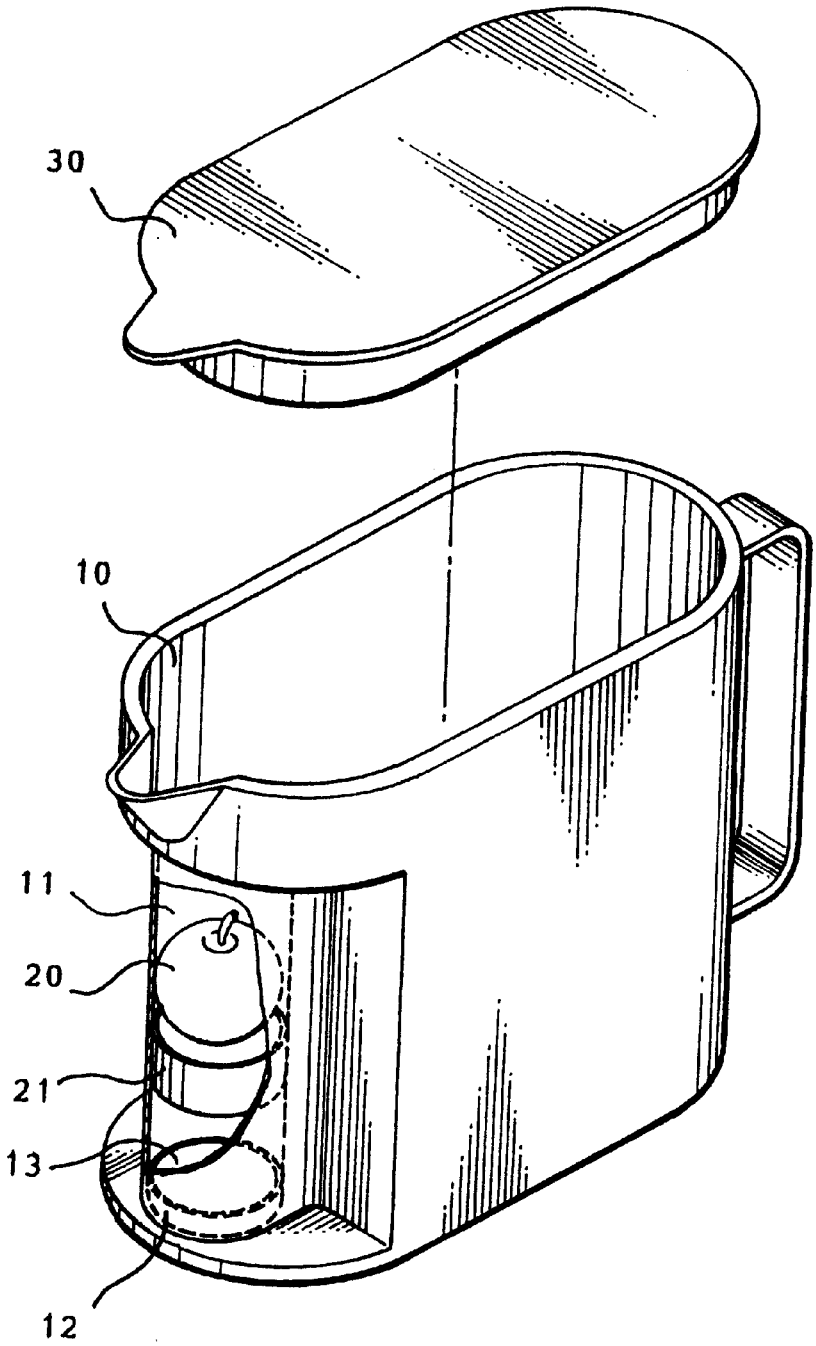
FIG. 12 shows a schematic view of a variation of the present invention as shown in FIG. 11.

As shown in FIG. 10, the main body 10 is provided with a lid 30 and is used as a drinking water container. As shown in FIGS. 11 and 12, the main body 10 is provided with a lid 30 and is used as a cup and the like.

The hollow tubular body 11 may be provided therein with one or more guide rails which are disposed between the first magnet 13 of the hollow tubular body 11 and the second magnet 13 of the ornament 20. In the meantime, the first magnet 13 and the second magnet 13 are provided with an engagement portion capable of moving along the guide rails. As a result, the ornament 20 moves up and down in a predetermined direction along the guide rails.

The ornament 20 and the second magnet 13 of the ornament 20 may be provided with a light-reflecting or light-emitting element for giving an added attraction to the ornament 20 in motion.

It is therefore readily apparent that the present invention has several advantages, which are described explicitly hereinafter.

The ornament is movably disposed in various containers such that the ornament is caused to move up and down or suspended by the repulsion effect of the magnets. The containers can thus draw curiosity of the consumers. In addition, the containers of the present invention are not only educational but also recreational.

The containers of the present invention are provided with a movable ornament which can be suspended due to the repulsion effect brought about by the magnets of the ornament and the end piece of the tubular body. The containers of the present invention are therefore not only educational but also recreational.

The ornament located in the main body of the present invention may be provided with a light-reflecting or light-emitting element to enhance the attractiveness of the present invention.

The main body of the present invention may be provided with or devoid of a handle or lid. The main body of the present invention may be a cup, a vessel, a pencil or pen can, a decorative vase, a coin collecting can, an hourglass, a stationery box, a shoe, a hat, a hand bag, a toy, etc.

What is claimed is:

1. A container having an ornament and comprising:

a main body of a hollow construction for holding a solid or liquid matter, said main body provided in one side thereof or in a center thereof with a hollow tubular body which is provided at a bottom end thereof with an end piece fastened therewith, said end piece provided in an upper side thereof with a first magnet; and an ornament disposed in said hollow tubular body such that said ornament moves freely and linearly in said hollow tubular body, said ornament provided in an underside of a bottom thereof with a second magnet capable of bringing about a repulsion effect along with said first magnet.

2. The container as defined in claim 1, wherein said first magnet and said second magnet are provided with an engagement portion; and wherein said hollow tubular body is provided with one or more guide rails on which said engagement portion of said first magnet and said engagement portion of said second magnet move in a predetermined direction.

3. The container as defined in claim 1, wherein said ornament or said second magnet is provided with a light-reflecting or light-emitting element.

4. The container as defined in claim 1, wherein said main body is provided with an open top and a lid covering said open top.

5. The container as defined in claim 1, wherein said main body has one or more handles.

6. The container as defined in claim 1, wherein said main body is provided with a shoulder strap.

* * * * *